US005474332A

United States Patent [19]

Yeh

[11] Patent Number: 5,474,332

[45] Date of Patent: Dec. 12, 1995

[54] WRAPAROUND COVER FOR A PAPERBACK BOOK

[76] Inventor: Christopher S. Yeh, 1454 Princeton St., No. 4, Santa Monica, Calif. 90404

[21] Appl. No.: 325,773

[22] Filed: Oct. 17, 1994

[51] Int. Cl.[6] ..... B42D 3/04

[52] U.S. Cl. ..... 281/19.1; 281/35; 281/34

[58] Field of Search ..... 281/15.1, 17, 19.1, 281/19.2, 20, 29, 34, 51; 402/70, 73

[56] References Cited

U.S. PATENT DOCUMENTS

| | | | |
|---|---|---|---|
| 407,363 | 7/1889 | Matthews | 281/29 |
| 2,317,748 | 4/1943 | Exline | 281/19.1 |
| 3,314,464 | 4/1967 | Veilleux | 281/19.1 |
| 5,009,361 | 4/1991 | Chariton et al. | 281/19.1 |

*Primary Examiner*—Willmon Fridie, Jr.
*Attorney, Agent, or Firm*—Benman Collins & Sawyer

[57] ABSTRACT

A removable, reusable, wrap-around cover for a paperback book consisting of a single sheet of semi-rigid synthetic plastic material, vertically scored with multiple lines to allow it to fit around varying thickness of book, with two pairs of flaps on each side and a single loop of elastic at the center of the sheet. The main sheet wraps around the covers and spine of the book, and folds over the edges of the front and rear covers to keep the cover on the book. The flaps are formed such that when the main sheet has been folded around the book, they can be folded onto the insides of the covers and linked together so that the two pairs of flaps form a pair of bands that keeps the edges of the main sheet folded around the covers of the book. The elastic loop stretches around the entire assembled cover and book, and keeps the book shut to protect it from damage.

3 Claims, 5 Drawing Sheets

WRAPAROUND COVER FOR A PAPERBACK BOOK

FIELD OF THE INVENTION

The present invention relates to a cover for a book and more particularly a wrap-around cover for a paperback book.

BACKGROUND OF THE INVENTION

Paperback books tend to be significantly less expensive and more portable than bound, hardcover books. As a result, many libraries, classrooms, and private citizens purchase large collections of paperback books for use and sale. However, because paperbacks are so portable, the type of usage these paperbacks see often includes being dropped, bent, spilled-on, stuffed, crammed and damaged during their use. Since the covers and spine of a paperback book are just that, paper, such usage can quickly render it unsalable and unusable. The problems of paperback durability are further exacerbated in the case of libraries and classrooms by the multiple readings by multiple readers each book may have to undergo. The most popular titles are the ones most quickly worn-out.

Although libraries frequently provide their classrooms with protective plastic and paper covers, such covers must often be manually cut and fitted to the individual books. Many such covers are either too flexible to truly protect the covers, or too rigid, thus placing too much strain on a small portion of the covers and spine. In addition, almost all such covers are fixed to books by non-reversible means such as adhesive tape or glue, requiring the purchase of a cover for each individual book.

Accordingly, what is needed is a book cover that can be utilized with paperback books that effectively projects the books. The book cover should be simple, flexible and easy to use. The present invention addresses such a need.

SUMMARY OF THE INVENTION

The primary object of the present invention is to provide a wrap-around cover for a paperback book which reduces or even eliminates the damage that occurs to such books during everyday transport and use.

Another object of the present invention is to provide a wrap-around cover for a paperback book wherein a single-size cover may be fitted to varying thicknesses and widths of book (given the same height.)

Another object of the present invention is to provide a wrap-around cover for a paperback book which is attached to the book in a reversible fashion such that it is both removable and reusable.

Another object of the present invention is to provide a wrap-around cover for a paperback book which includes an elastic strap to hold the covers of the book shut for greater protection and ease of transport.

Another object of the present invention is to provide a wrap-around cover for a paperback book formed of a transparent material whereby printing on the front and rear covers and the spine of the book are visible through the wrap-around cover.

Another object of the present invention is to provide a wrap-around cover for a paperback book which will prevent fading and damage to the book due to exposure to ultraviolet light.

A more particular object of the present invention is to provide a wrap-around cover for a paperback book consisting of a single sheet of semi-rigid synthetic plastic material, vertically scored with multiple lines to allow it to fit around varying thicknesses of book, with two pairs of flaps on each side and a single loop of elastic at the center of the sheet. The main sheet wraps around the covers and spine of the book, and folds over the edges of the front and rear covers to keep the cover on the book. The flaps are formed such that when the main sheet has been folded around the book, they can be folded onto the insides of the covers and linked together so that the two pairs of flaps form a pair of bands that keeps the edges of the main sheet folded around the covers of the book. The elastic loop stretches around the entire assembled cover and book, and keeps the book shut to protect it from damage.

BRIEF DESCRIPTION OF THE DRAWINGS

These and other objects and advantages of the present invention will become apparent from the following detailed description, with reference to the accompanying drawings wherein: *Note: There are some minor inconsistencies between the drawings. When in doubt.

FIG. 2 is a view from above of the wrap-around cover of FIG. 1, unfolded into a single flat sheet.

DESCRIPTION OF THE PREFERRED EMBODIMENTS

The present invention relates to an improvement in a wrap around cover for a paperback book. The following description is presented to enable one of ordinary skill in the art to make and use the invention as provided in the context of a particular application and its requirements. Various modifications to the preferred embodiments will be readily apparent to those skilled in the art, and the generic principles defined here may be applied to other embodiments. Thus, the present invention is not intended to be limited to the embodiments shown, but is to be accorded the widest scope consistent with the principles and novel features disclosed herein.

Figure 1:
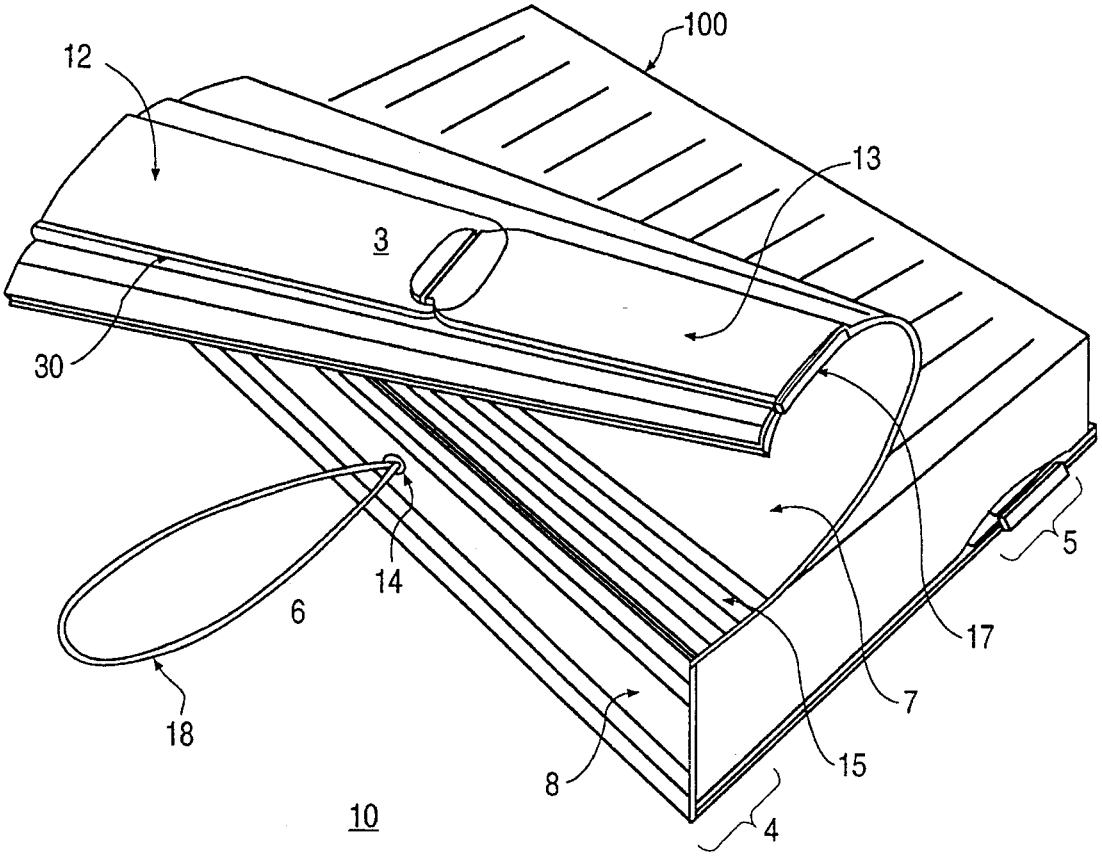
FIG. 1 is a perspective view of a paperback book upon which is arranged a wrap-around cover embodying the present invention, the book being shown in the closed position with only the front cover open.
Figure 2:
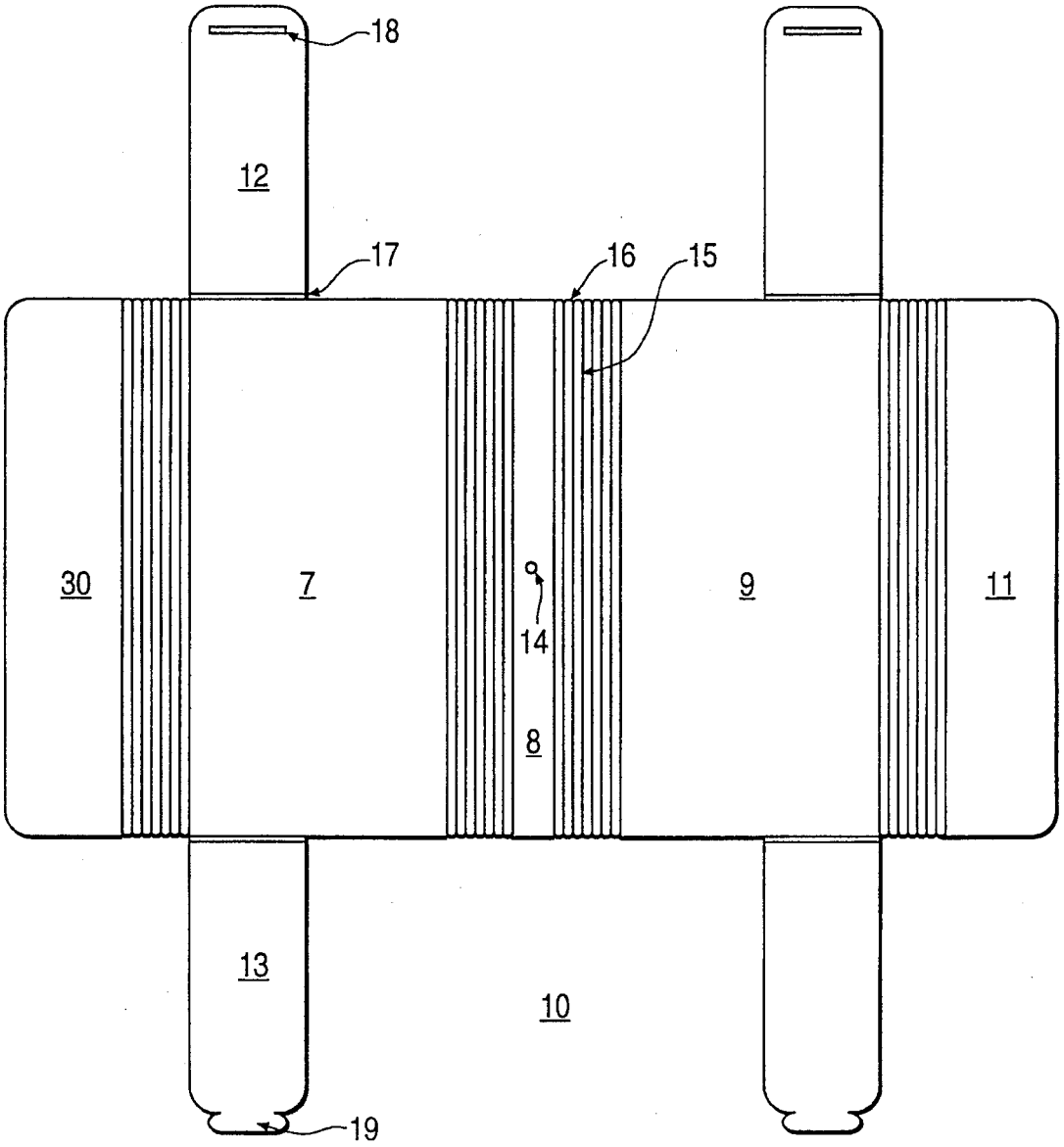
FIG. 2 represents the most refined embodiment of the present invention.

Referring to the drawings and particularly FIGS. 1 and 2, there is shown a wrap-around cover member 10 for a paperback book in accordance with the present invention.

The cover member 10 comprises a single thin sheet of transparent plastic, (see FIG. 2), cut into a shape which allows it to best wrap around a paperback book 100. Referring now to FIG. 2, the cover member 10 includes a front cover portion 7, a vertical spine 8, and a rear cover 9 which wrap around the exterior of a paperback book, protecting the covers and spine of the book, while allowing the user a clear view of the cover art, the title on the spine, and the rear cover. The spine 8 has a housing 14 for attaching an elastic cord 18. The cover member 10 in accordance with the present invention also includes horizontal front and rear flaps 30 and 11, respectively, which wrap horizontally around the covers of the book 100, holding the cover member 10 in place. After the front and rear flaps 30 and 11 have been wrapped around the covers of the paperback book, the vertical female and male flaps 12 and 13 fold around the double hinges 17 and lock together around the front and rear flaps 12 and 13, holding flaps 30 and 11 in place. When the book, with the wrap-around cover member 10 on it, is closed, the vertical flaps 12 and 13 fall on the insides of the covers, where they do not interfere with the appearance of the exterior of the book 100.

The scored lines 15 are long, parallel grooves cut into the plastic of the cover to create a series of living hinges. The ability to fold front and rear flaps 30 and 11, as well as the spine 8, around any of these scored lines 15 allows the cover member 10 to fit around paperback books of different thickness, ranging anywhere from, for example in a preferred embodiment, 0.625" to 2.0". The semi-circular cuts 16 prevent the cover member 10 from creating dangerously sharp corners when folded along the score lines 15; all corners are rounded instead.

Figure 3A:
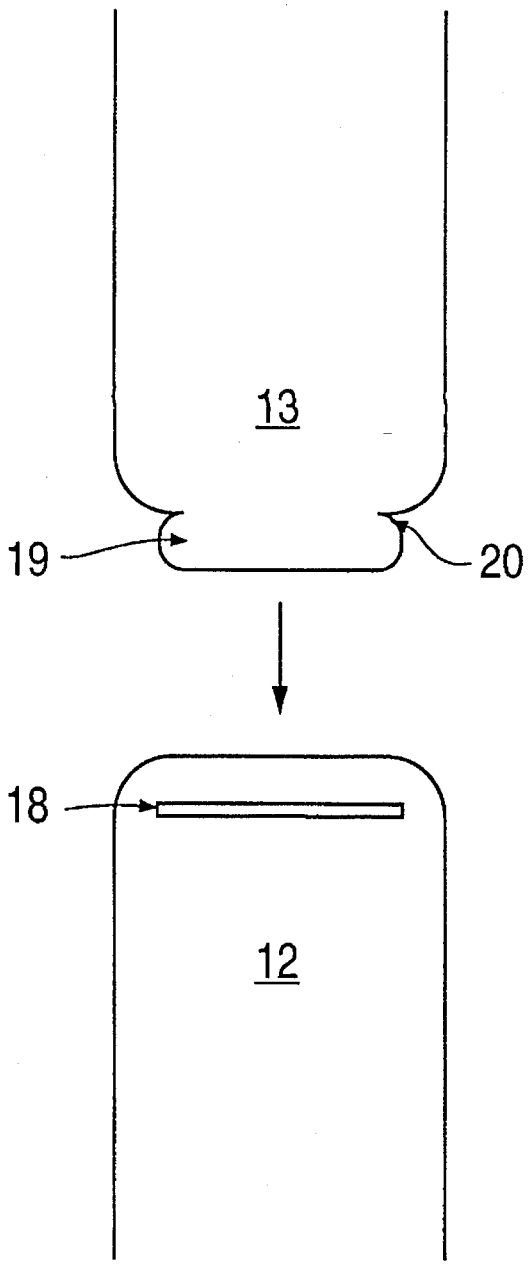
FIG. 3 is an enlarged view from above of the portion of FIG. 1 designated 3. This view illustrates the interlocking flaps used to lock the cover in place around the paperback book.
Figure 3B:
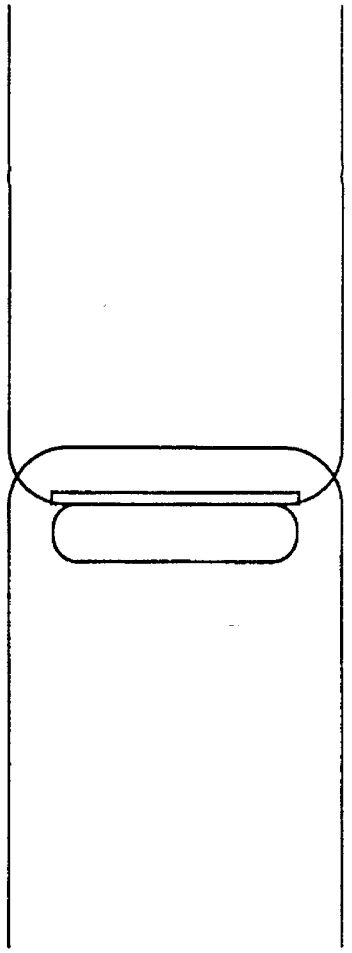

Referring now to FIG. 3, the mechanism for locking the vertical flaps 12 and 13 together comprises a tab and slot system. The tab 19 of vertical flap 13 comprises, in a preferred embodiment, a rounded piece of plastic which reaches a narrow neck 20 at the point where it joins the flap 13. The slot 18 is just wider than the narrow neck 20, but narrower than the wider portions of the tab 19, so that when the tab 19 is pushed into the slot, the flaps 12 and 13 are held in a reversible mechanical bond.

Figure 4A:
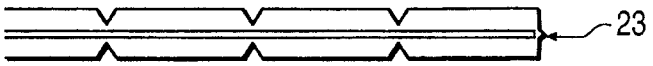
FIGS. 4A–4C are enlarged side views of the portion of FIG. 1 designated 4. This view illustrates the nature of the living hinges used to give the wrap-around cover its adjustability.
Figure 4B:
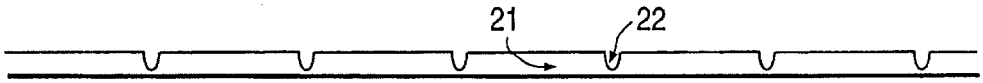
Figure 4C:
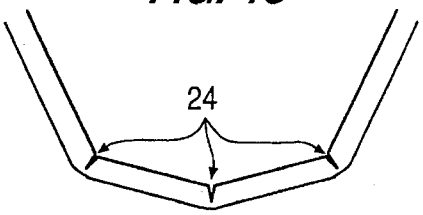

Referring now to FIGS. 4A–4C, the scored lines comprise parallel grooves 22 cut into thin plastic sheet 21. These grooves 22 allow the sheet to be bent completely over shown at 23 in one direction, and increase flexibility in the other direction shown at 24.

Figure 5:
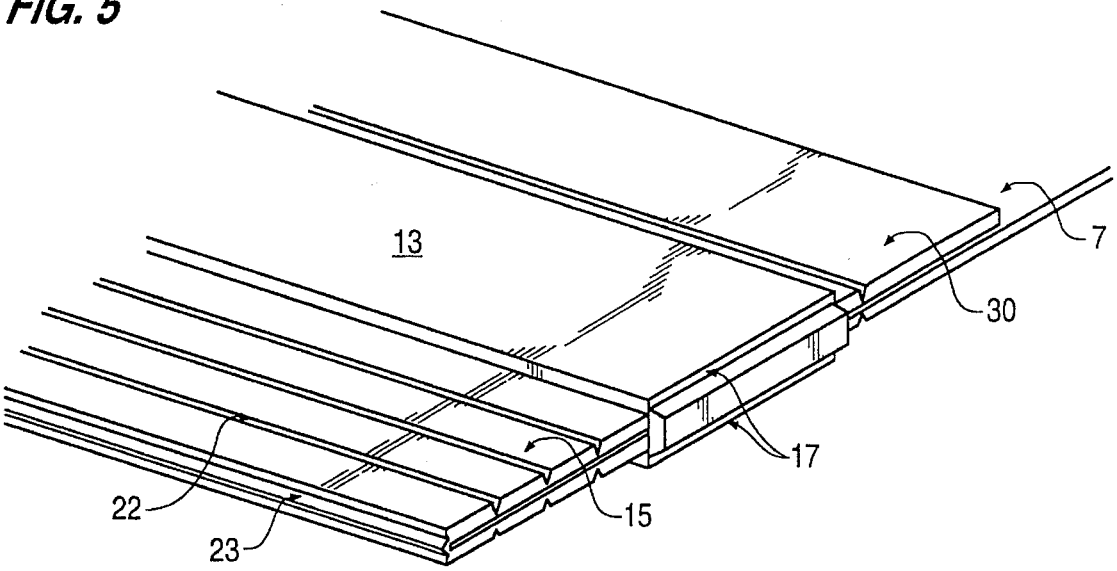
FIG. 5 is an enlarged perspective view of the portion of FIG. 1 designated 5. This view shows in detail the double hinges used to lock the front flap and front cover around the cover of the paperback book.
Figure 6A:
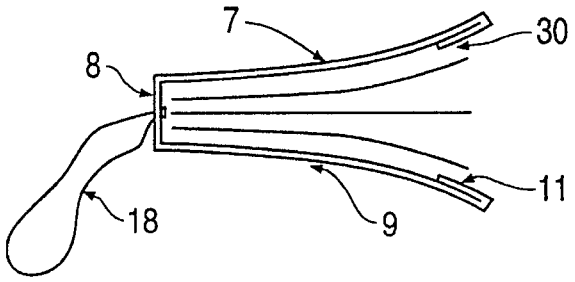
FIGS. 6A–6D are side views of the entire cover/book assembly. These views illustrates the manner in which an elastic cord is used to hold the cover/book assembly shut when the user is not reading.
Figure 6C:
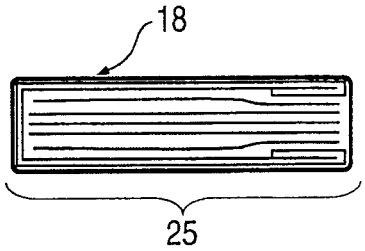
Figure 6B:
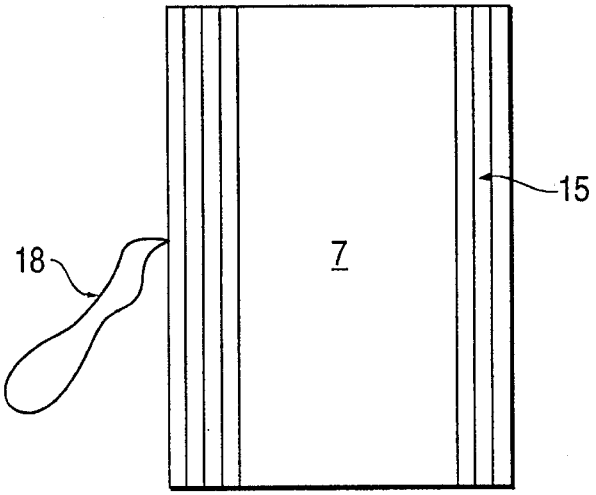
Figure 6D:
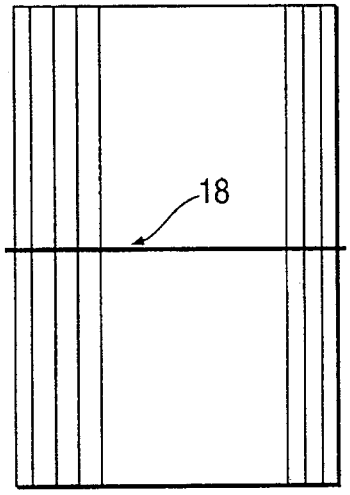

Referring now to FIG. 5, the double hinge 17 folds around the flap 30 and holds it next to the cover 7.

Referring now to FIGS. 6A–6D, the elastic cord 18 stretches around the wrap-around cover and book to hold both in a shut position 25 when not being read.

The cover member 10 in accordance with the present invention is easily installed upon a paperback book 100 by arranging the cover member 10 in its open position of FIG. 2 and folding along the scored lines 15 around the spine 8 to fit the width of the book's spine. Then the cover member 10 is folded along the scored lines 15 beside the front and rear flaps 30 and 11 to fit the width of the book's covers, thereby folding flaps 30 and 11 to the inside of the covers. Then the vertical flaps 12 and 13 are folded along the double hinges 17, thereafter tab 19 and slot 18 are locked together to form the constraining bands which hold the front and rear flaps 30 and 11 in place.

Although the present invention has been described in accordance with the embodiments shown in the figures, one of ordinary skill in the art recognizes there could be variations to the embodiments and those variations would be within the spirit and scope of the present invention. Accordingly, many modifications may be made by one of ordinary skills in the art without departing from the spirit and scope of present invention, the scope of which is defined solely by the appended claims.

I claim:

1. A wrap-around cover for a book comprising:

a sheet of semi-rigid material; the sheet including:

a cover portion;

a plurality of vertically scored lines on the cover portion for accommodating varying widths and thicknesses of the book; and holding means coupled to the cover portion for securing the sheet to the book, the holding means comprising first and second securing means coupled to each side of the cover portion, each of the first and second securing means comprises a first flap portion coupled to the cover portion, the first flap portion including an aperture therethrough; and a second flap portion coupled to the cover portion, the second portion including a tab extending therefrom; the tab member being coupled through aperture so as to allow the first and second flap portion form a band that allows the sheet to surround the book.

2. A wrap-around cover for a book comprising:

a sheet of semi-rigid material; the sheet including:

a cover portion;

a plurality of vertically scored lines on the cover portion for accommodating varying widths and thicknesses of the book;

holding means coupled to the cover portion for securing the sheet to the book, the holding means comprising first and second securing means coupled to each side of the cover portion, each of the first and second securing means comprises a first flap portion coupled to the cover portion, the first flap portion including an aperture therethrough; and a second flap portion coupled to the cover portion, the second portion including a tab extending therefrom; the tab member being coupled through aperture so as to allow the first and second flap portion form a band that allows the sheet to surround the book; and an elastic loop coupled to the cover portion which removably stretches around the cover portion when the book is in a closed position.

3. A wrap-around cover for a book comprising:

a sheet of semi-rigid synthetic plastic material; the sheet including:

a cover portion;

a plurality of vertically scored lines on the cover portion for accommodating varying thicknesses of the book;

first and second securing means coupled to each side of the cover portion; the first and second securing means further comprising a first flap portion coupled to the cover portion, the first flap portion including an aperture therethrough; a second flap portion coupled to cover portion, the second portion including a first tab extending therefrom; the tab member being coupled through aperture so as to allow the first and second flap portion form a band that allows the sheet to surround the book; a third flap portion coupled to the cover portion, the first flap portion including an aperture therethrough; a fourth flap portion coupled to cover portion, the second portion including a second tab extending therefrom; the second tab member being coupled through aperture so as to allow the third and fourth flap portions form a band that allows the sheet to surround the book; and an elastic loop coupled to the cover portion at the center portion thereof which removably stretches around the cover portion when the book is in a closed position.

* * * * *